US009372442B2

(12) United States Patent
Xu et al.

(10) Patent No.: US 9,372,442 B2
(45) Date of Patent: Jun. 21, 2016

(54) DEVELOPING CARTRIDGE

(71) Applicant: Brother Kogyo Kabushiki Kaisha, Nagoya-shi, Aichi-ken (JP)

(72) Inventors: Fan Xu, Nagoya (JP); Takashi Shimizu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/489,862

(22) Filed: Sep. 18, 2014

(65) Prior Publication Data

US 2015/0086236 A1 Mar. 26, 2015

(30) Foreign Application Priority Data

Sep. 20, 2013 (JP) ..... 2013-195664

(51) Int. Cl.
*G03G 21/18* (2006.01)
*G03G 15/08* (2006.01)

(52) U.S. Cl.
CPC ..... *G03G 15/0896* (2013.01); *G03G 15/0898* (2013.01); *G03G 21/181* (2013.01); *G03G 21/1828* (2013.01)

(58) Field of Classification Search
CPC ..... G03G 15/0817; G03G 15/0881; G03G 15/0894; G03G 15/0896; G03G 15/0898; G03G 2215/0855; G03G 21/1803; G03G 21/181; G03G 21/1828
See application file for complete search history.

(56) References Cited

U.S. PATENT DOCUMENTS

| | | | | |
|---|---|---|---|---|
| 8,320,793 | B2 * | 11/2012 | Xu et al. | 399/103 |
| 8,606,139 | B2 * | 12/2013 | Xu et al. | 399/103 |
| 8,818,247 | B2 * | 8/2014 | Mori | 399/284 |
| 8,983,346 | B2 * | 3/2015 | Fukamachi | 399/284 |
| 2011/0064453 | A1 * | 3/2011 | Xu et al. | 399/103 |
| 2011/0064454 | A1 * | 3/2011 | Xu et al. | 399/103 |
| 2011/0158687 | A1 | 6/2011 | Mori | |
| 2011/0236058 | A1 * | 9/2011 | Nakajima | 399/103 |
| 2013/0051868 | A1 * | 2/2013 | Fukamachi | 399/284 |

FOREIGN PATENT DOCUMENTS

JP 2011-133757 A 7/2011

* cited by examiner

*Primary Examiner* — David Gray
*Assistant Examiner* — Carla Therrien
(74) *Attorney, Agent, or Firm* — Banner & Witcoff, Ltd.

(57) ABSTRACT

A developing cartridge includes a housing configured to accommodate a developing agent and including a first frame and a second frame, a developing agent carrying member rotatable on an axial line and configured to carry the developing agent, and a layer thickness regulating member configured to regulate a layer thickness of the developing agent carried by the developing agent carrying member. The first frame has a first facing surface facing the layer thickness regulating member. The second frame has a second facing surface facing the layer thickness regulating member. A welded region where the first frame and the second frame are welded and include a first welded portion extending from the first facing surface in a first direction intersecting with and away from the first facing surface, and a second welded portion extending from the first welded portion inward in a second direction intersecting with the first direction.

5 Claims, 12 Drawing Sheets

DEVELOPING CARTRIDGE

CROSS-REFERENCE TO RELATED APPLICATION

This application claims priority from Japanese Patent Application No. 2013-195664, filed on Sep. 20, 2013, which is incorporated herein by reference in its entirety.

TECHNICAL FIELD

Aspects disclosed herein relate to a developing cartridge used in an image forming apparatus which employs electrophotography.

BACKGROUND

There are known electrophotographic image forming apparatuses having an image carrying member which carries an electrostatic latent image, and a developing cartridge which supplies a developing agent to the electrostatic latent image on the image carrying member.

There is proposed, as a developing cartridge mounted to such an image forming apparatus, a developing cartridge including a frame, a developing roller supported at a rear end portion of the frame, and a layer thickness regulating blade supported at the rear end portion of the frame, for example.

This developing cartridge has a lower frame formed as a frame with a bottom but opened upwards and to the rear, and an upper frame which is assembled to the lower frame from above. The upper frame is welded to left and right side walls and a front wall of the lower frame, at left and right edge portions and a front portion of the upper frame.

A seal which seals between the rear end portion of the frame and the layer thickness regulation blade covers and seals the seam between left and right edges of the upper frame and the left and right side walls of the lower frame, from the rear side, that the left and right ends thereof.

SUMMARY

The welded region of the upper frame and lower frame in such developing cartridges only extends in the front-back direction toward the layer thickness regulation blade, at the seam between the left and right edges of the upper frame and the left and right side walls of the lower frame.

Accordingly, any toner leaking toward the layer thickness regulation blade along the welded region is sealed only by the sealing member, and there may be cases where preventing leakage of toner toward the layer thickness regulation blade is difficult.

Accordingly, it is an object of the present invention to provide a developing cartridge in which seams between a first frame and a second frame can be sealed reliably.

According to one or more aspects of the disclosure, a developing cartridge may include a housing configured to accommodate a developing agent and including a first frame and a second frame, a developing agent carrying member rotatable on an axial line and configured to carry the developing agent, and a layer thickness regulating member configured to regulate a layer thickness of the developing agent carried by the developing agent carrying member. The first frame may have a first facing surface facing the layer thickness regulating member. The second frame may have a second facing surface facing the layer thickness regulating member. A welded region where the first frame and the second frame may be welded and include a first welded portion extending from the first facing surface in a first direction intersecting with and away from the first facing surface, and a second welded portion extending from the first welded portion inward in a second direction intersecting with the first direction.

According to one or more other aspects of the disclosure, a developing cartridge may include a housing configured to accommodate a developing agent and include a first frame and a second frame, a developing roller rotatable and configured to carry the developing agent, a layer thickness regulating member configured to regulate a layer thickness of the developing agent carried by the developing roller, and a seal disposed between the housing and the layer thickness regulating member. The first frame may have a first surface configured to support the seal. The second frame may have a second surface configured to support the seal. A welded region may include a first welded portion extending from the first surface in a first direction intersecting with the first surface and contacting the seal.

DETAILED DESCRIPTION

1. Overview of Developing Cartridge

Figure 1:
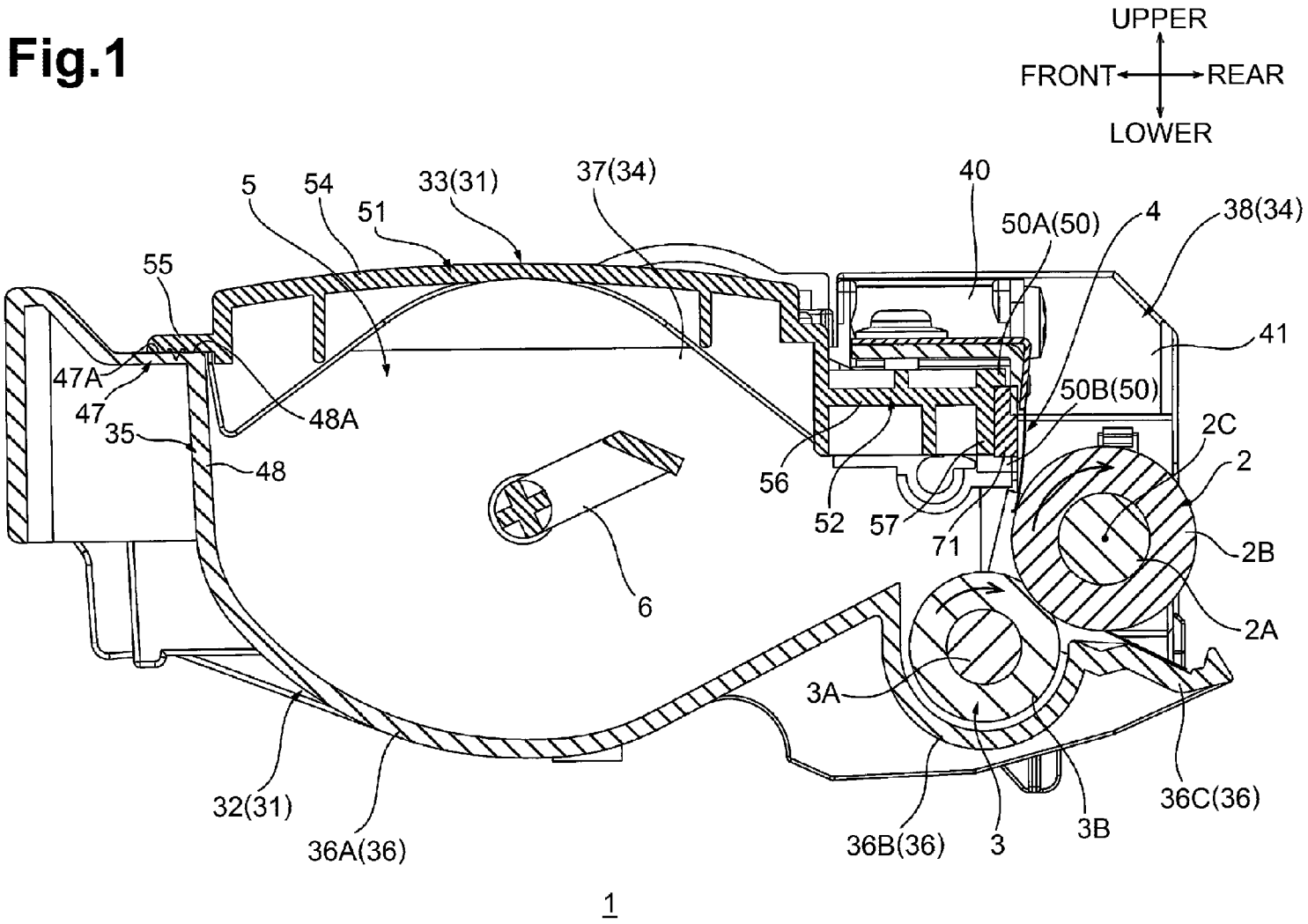
FIG. 1 is a cross-sectional view taken along the middle of a developing cartridge according to the present embodiment.

As illustrated in FIG. 1, a developing cartridge 1 includes a developing roller 2 which is an example of a developing agent carrying member, a supply roller 3, a layer thickness regulating blade 4 which is an example of a layer thickness regulating member, and a toner accommodating unit 5.

Note that in the following description, directions of the developing cartridge 1 will be referred to based on a state where the developing cartridge 1 is installed flat and level for the vertical direction. That is to say, in FIG. 1 the top side in the plane of the drawing is upwards, and the bottom side in the plane of the drawing is downwards. Also in FIG. 1, the left side in the plane of the drawing is the front, and the right side in the plane of the drawing is the rear. Based on the left and right when viewing the developing cartridge 1 from the front, the near side in the drawing in FIG. 1 is the right side, and the far side in the drawing is the left side. Further, the front-back direction is one example of a first direction. The left-right direction is one example of a second direction.

The developing roller 2 is rotatably supported at the rear end portion of the developing cartridge 1. The developing roller 2 includes a developing roller shaft 2A and a developing roller main unit 2B.

The developing roller shaft 2A has a general columnar shape, extending in the left-right direction. That is to say, a center axial line 2C of the developing roller shaft 2A extends in the left-right direction. The center axial line 2C of the developing roller shaft 2A is an example of an axial line. The developing roller shaft 2A is formed of metal. The left and right ends of the developing roller shaft 2A are inserted into developing roller shaft insertion holes 43 of a later-described developing frame 31.

The developing roller main unit 2B has a general cylinder shape extending in the left-right direction. The developing roller main unit 2B is formed of a rubber having electroconductivity. The developing roller main unit 2B does not cover the left and right ends of the developing roller shaft 2A but rather covers the general middle of the developing roller shaft 2A in the left-right direction.

The supply roller 3 is disposed to the lower front of the developing roller 2. The supply roller 3 is rotatably supported by the developing cartridge 1. The supply roller 3 includes a supply roller shaft 3A and a supply roller main unit 3B.

The supply roller shaft 3A has a general columnar shape extending in the left-right direction. The supply roller shaft 3A is formed of metal. The left and right ends of the supply roller shaft 3A are inserted to supply roller attachment portions 39 of the developing frame 31 which will be described later.

The supply roller main unit 3B has a general cylinder shape extending in the left-right direction. The supply roller main unit 3B is formed of a sponge having electroconductivity. The supply roller main unit 3B does not cover the left and right ends of the supply roller shaft 3A but rather covers the general middle of the supply roller shaft 3A in the left-right direction. The supply roller main unit 3B comes into contact with a lower front portion of the developing roller main unit 2B.

The layer thickness regulating blade 4 is disposed to the upper front of the developing roller 2. The layer thickness regulating blade 4 comes into contact with the front end portion of the developing roller main unit 2B.

The toner accommodating unit 5 is disposed to the front of the supply roller 3 and layer thickness regulating blade 4. The toner accommodating unit 5 is configured to accommodate toner, which is an example of developing agent. The toner accommodating unit 5 includes an agitator 6.

The agitator 6 is rotatably supported within the toner accommodating unit 5.

2. Usage Form of Developing Cartridge

Figure 2:
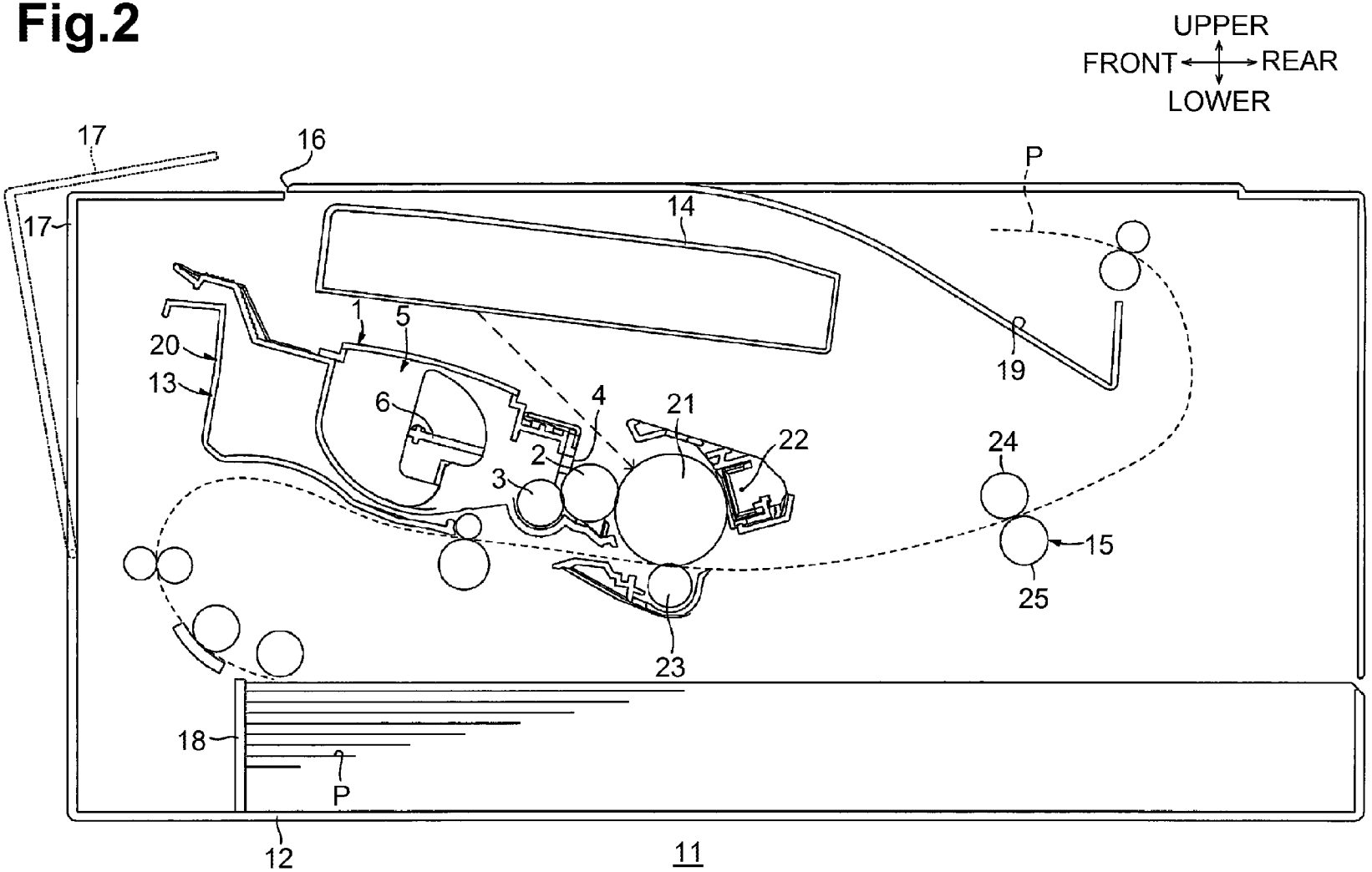
FIG. 2 is a cross-sectional view taken along the middle of an image forming apparatus in which is mounted the developing cartridge illustrated in FIG. 1.

The developing cartridge 1 is used by being mounted to an image forming apparatus 11, as illustrated in FIG. 2.

The image forming apparatus 11 is an electrophotographic black-and-white printer. The image forming apparatus 11 includes an apparatus main unit 12, a process cartridge 13, a scanner unit 14, and a fixing unit 15.

The apparatus main unit 12 has a general box shape. The apparatus main unit 12 has an opening portion 16, a front cover 17, a sheet feed tray 18, and a sheet discharge tray 19.

The opening portion 16 is situated at the front end of the apparatus main unit 12 and is opened in the front-back direction, allowing passage of the process cartridge 13.

The front cover 17 is disposed to the front end portion of the apparatus main unit 12. The front cover 17 has a general plate form, extending vertically, supported by the lower edge thereof as a pivot so was to be capable of rocking as to the front wall of the apparatus main unit 12. The front cover 17 is configured so as to open or close the opening portion 16.

The sheet feed tray 18 is disposed on the bottom within the apparatus main unit 12, and is configured to store sheets P.

The sheet discharge tray 19 is disposed on the rear half portion of the upper wall of the apparatus main unit 12. The sheet discharge tray 19 is recessed downwards from the upper face of the apparatus main unit 12 so as to load sheets P.

The process cartridge 13 is situated at the general middle of the apparatus main unit 12 in the vertical direction, and is configured to be mounted to and detached from the apparatus main unit 12. The process cartridge 13 includes a drum cartridge 20 and the developing cartridge 1.

The drum cartridge 20 includes a photosensitive drum 21, a scorotron charger 22, and a transfer roller 23.

The photosensitive drum 21 is rotatably supported at the rear end of the drum cartridge 20.

The scorotron charger 22 is disposed behind the photosensitive drum 21, with spacing provided between the photosensitive drum 21 and scorotron charger 22.

The transfer roller 23 is disposed beneath the photosensitive drum 21. The transfer roller 23 comes into contact with the bottom portion of the photosensitive drum 21.

The developing cartridge 1 mounted to the drum cartridge 20 such that the developing roller 2 comes into contact with the front portion of the photosensitive drum 21.

The scanner unit 14 is disposed above the process cartridge 13. The scanner unit 14 is configured to emit a laser beam, based on image data, toward the photosensitive drum 21.

The fixing unit 15 is disposed behind the process cartridge 13. The fixing unit 15 includes a heating roller 24, and a pressure roller 25 which is pressed against the lower rear portion of the heating roller 24.

Upon the image forming apparatus 11 starting image forming operations, the scorotron charger 22 uniformly charges the surface of the photosensitive drum 21. The scanner unit 14 exposes the surface of the photosensitive drum 21. Thus, an electrostatic latent image based on the image data is formed on the surface of the photosensitive drum 21.

The agitator 6 stirs toner within the toner accommodation unit 5, so as to be supplied to the supply roller 3. The supply roller 3 supplies the toner supplied from the agitator 6 to the developing roller 2. At this time, the toner is charged by friction to a positive polarity between the developing roller 2 and the supply roller 3, and is carried by the developing roller 2. The layer thickness regulating blade 4 regulates the thickness of the toner layer carried on the developing roller 2 to a constant thickness.

The toner carried by the developing roller 2 is then supplied to the electrostatic latent image on the surface of the photosensitive drum 21. Accordingly, a toner image is carried on the surface of the photosensitive drum 21.

Sheets P are fed one at a time from the sheet feed tray 18, at predetermined timings, by rotation of various rollers, and fed to the nip of the photosensitive drum 21 and transfer roller 23. The toner image on the photosensitive drum 21 is transferred to the sheet P when passing between the photosensitive drum 21 and the transfer roller 23.

Thereafter, the sheet P is heated and pressurized when passing between the heating roller 24 and the pressure roller 25. The toner image on the sheet P is thermally fixed to the sheet P at this time. Thereafter, the sheet P is discharged to the sheet discharge tray 19.

3. Detailed Description of Developing Cartridge

Figure 3:
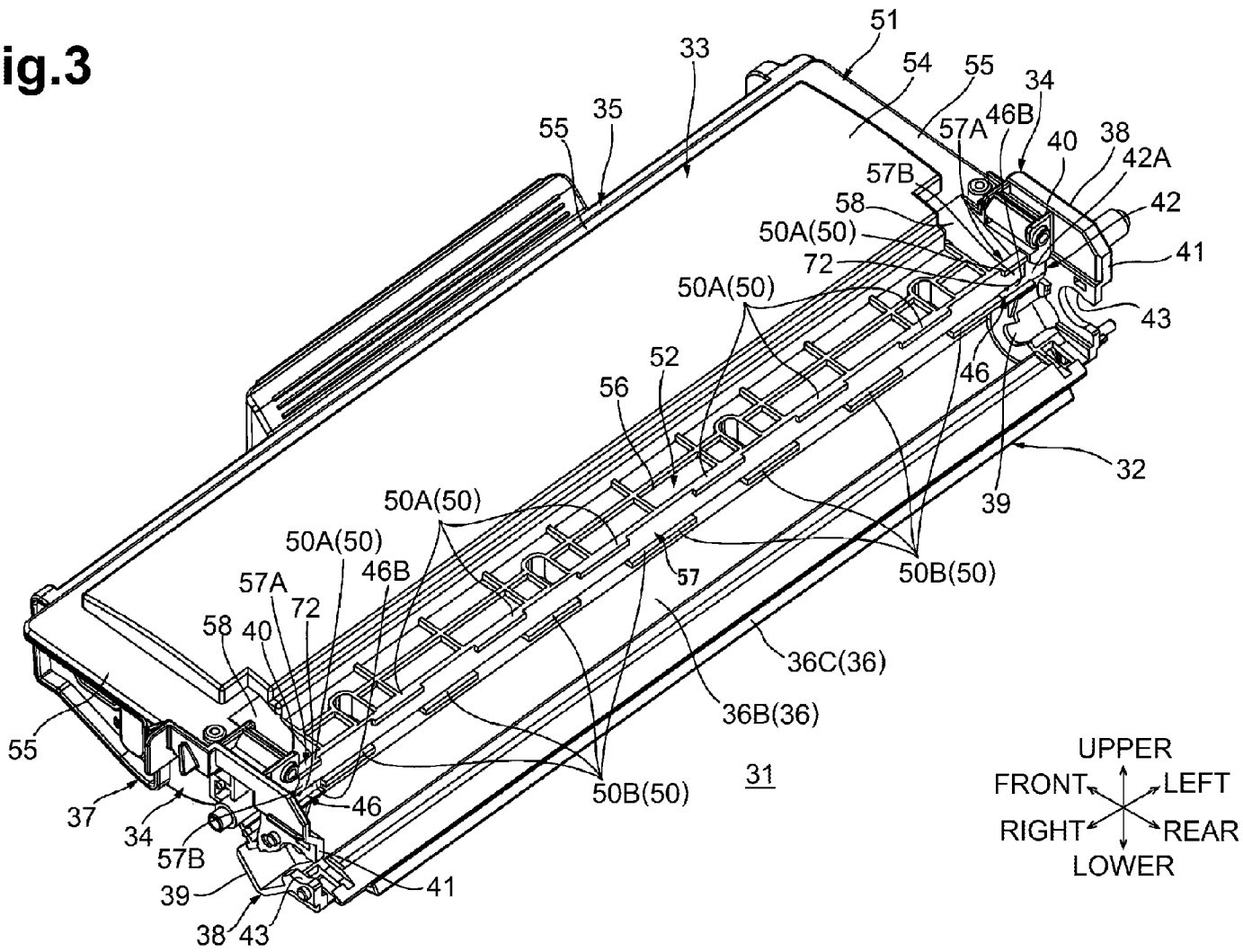
FIG. 3 is a perspective view illustrating a developing frame illustrated in FIG. 2 from the upper rear.
Figure 8:
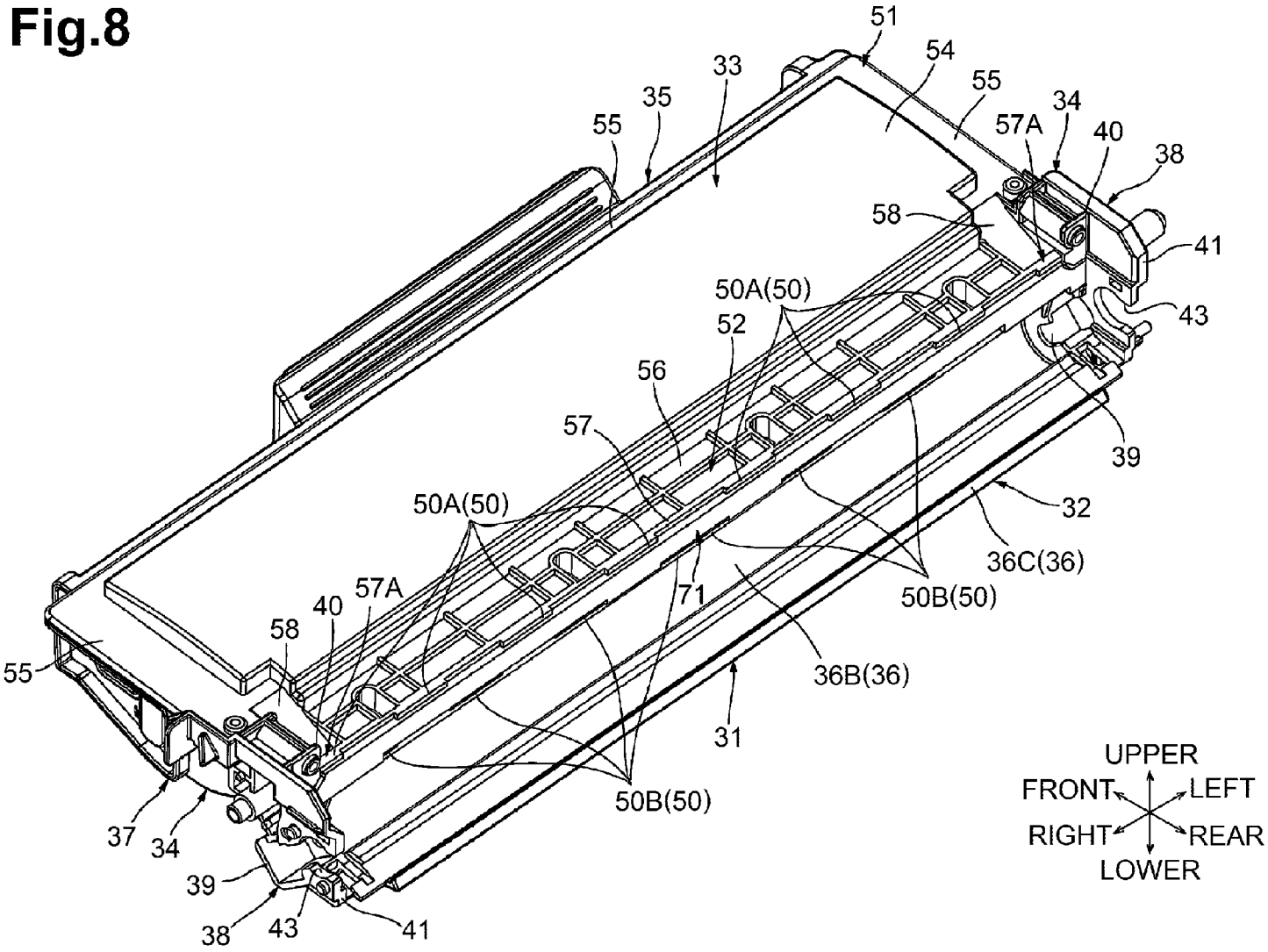
FIG. 8 is an explanatory diagram for describing assembling of a blade seal to the developing frame.

The developing cartridge 1 includes the developing frame 31 which is an example of a housing, and a blade seal 71 which is an example of a seal, as illustrated in FIGS. 3 and 8.

(1) Developing Frame

The developing frame 31 has a general box shape. The rear end portion of the developing frame 31 is opened. The developing frame 31 includes a base frame 32 which is an example of a first frame, and a cover frame 33 which is an example of a second frame.

(1-1) Base Frame

Figure 4A:
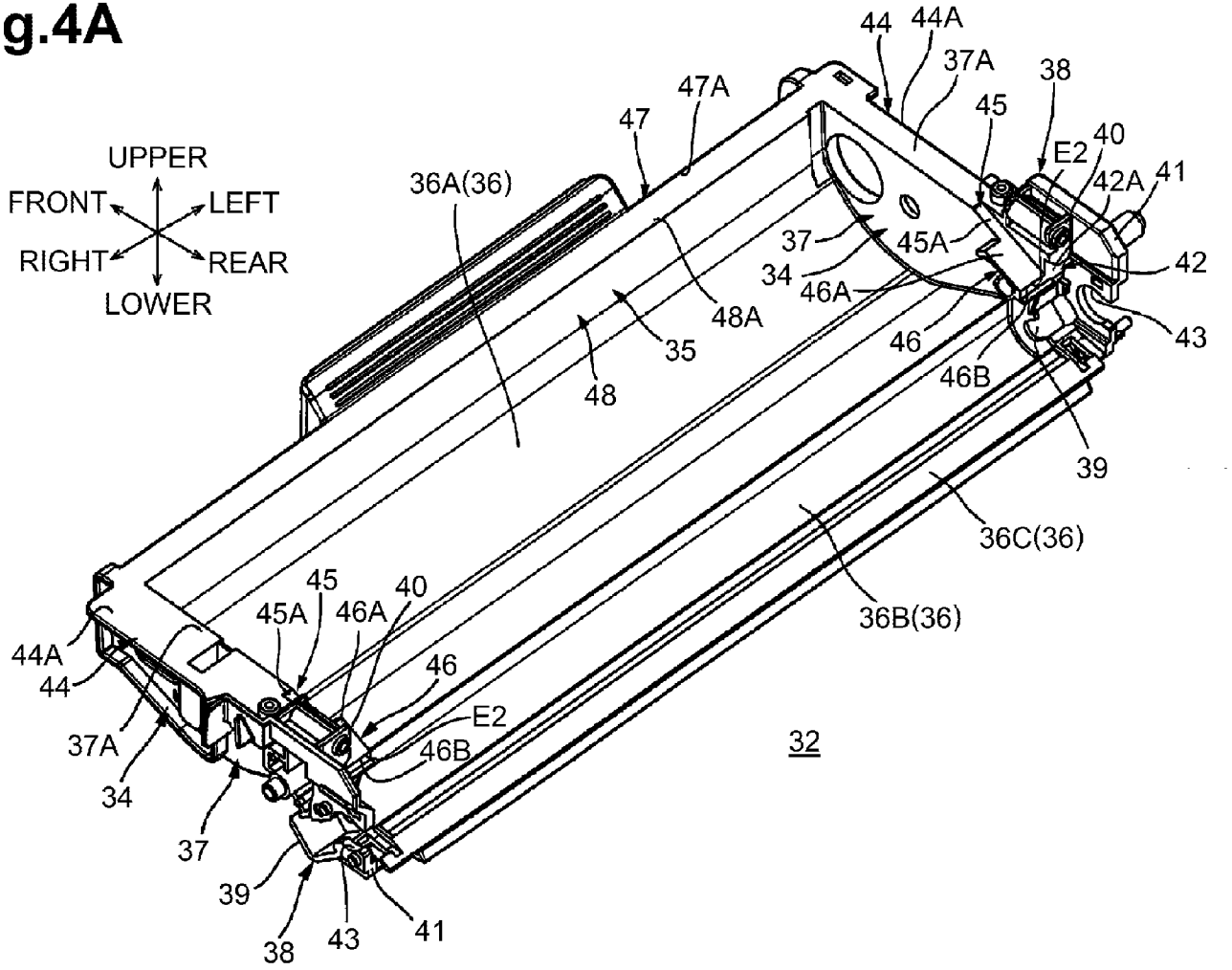
FIG. 4A is a perspective view illustrating a base frame illustrated in FIG. 3 from the upper rear.
Figure 4B:
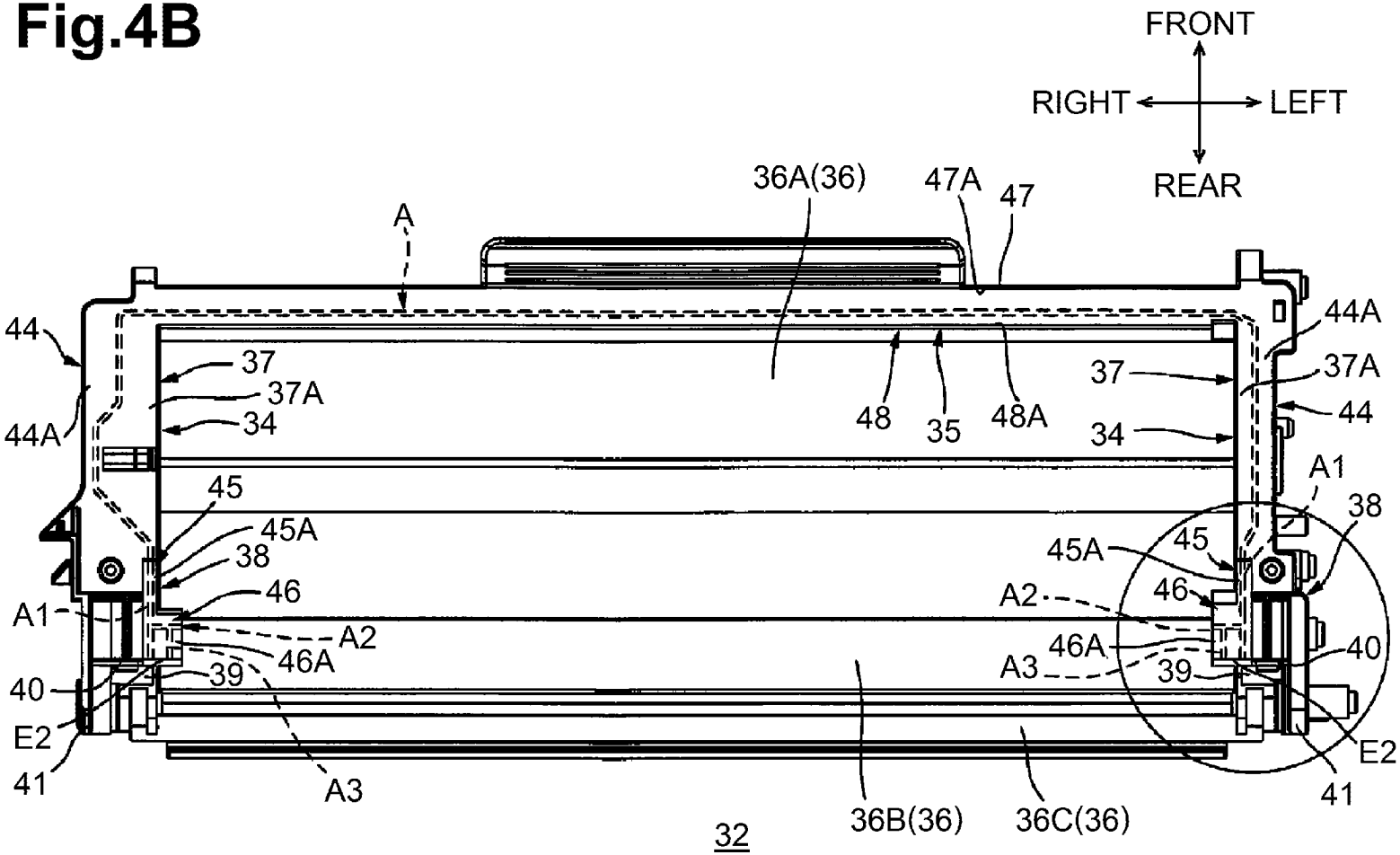
FIG. 4B is a plan view of the base frame illustrated in FIG. 3.

The base frame 32 has a form of a frame with a bottom, as illustrated in FIGS. 4A and 4B. The base frame 32 integrally includes a pair of side walls 34, a front wall 36, and a lower wall 36.

Each of the side walls 34 is disposed one and the other of the left and right edges of the base frame 32. Each side wall 34 has a main portion 37, a flange 44, and an attaching portion 38.

The main portion 37 is disposed at the front half of the side wall 34. The main portion 37 has a general plate shape, extending in the front-back direction. An upper face 37A of the main portion 37 extends in the front-back direction. The main portions 37 make up of left and right side walls of the toner accommodating unit 5. Each main portion 37 has an inclined portion 45.

The inclined portions 45 are situated at the inner edge portions of the main portions 37 in the left-right direction, and the upper front portions thereof. An upper face 45A of the inclined portion 45 continues to the upper face 37A of the main portion 37, and inclines downward toward the rear.

The flanges 44 protrude outwards in the left and right direction form the upper edges of the main portions 37, and extend in the front-back direction. Each flange 44 has a general plate shape, generally rectangular in plan view. An upper face 44A of the flange 44 continues to the upper face 37A of the main portion 37, and extends in the front-back direction.

The attaching portions 38 are disposed on the rear half of the side walls 34. The attaching portions 38 extend toward the front, continuous from the left and right outer edges at the rear edge of the main portions 37. Each attaching portion 38 has a general plate shape, generally rectangular in side view. Each attaching portion 38 includes a supply roller attaching portion 39, a seal facing portion 42, a blade attaching portion 40, a developing roller attaching portion 41, and a protrusion 46.

The supply roller attaching portion 39 is disposed at the lower edge at the front half of the attaching portion 38. The supply roller attaching portion 39 has a general cylinder shape extending in the left-right direction and opened toward the upper rear.

The seal facing portion 42 is disposed upwards and continuous from the supply roller attaching portion 39, at the general vertically middle portion of the front half of the attaching portion 38. The seal facing portion 42 has a generally rectangular shape in rear view, extending in the left-right direction. A rear face 42A of the seal facing portion 42 extends vertically.

The blade attaching portion 40 is disposed upwards and continuous from the seal facing portion 42, at the upper edge portion of the front half of the attaching portion 38. The blade attaching portion 40 has a generally square cylinder shape extending in the front-back direction. The rear edge of the blade attaching portion 40 protrudes toward the rear farther than the rear face of the seal facing portion 42. The rear face of the blade attaching portion 40 extends vertically, and has a generally rectangular shape in rear view.

The developing roller attaching portions 41 are disposed at the rear half of the attaching portion 38. The developing roller attaching portions 41 continuously extend backwards from the left and right outer edge of the supply roller attaching portion 39, seal facing portion 42, and blade attaching portion 40. The developing roller attaching portion 41 has a general plate shape, generally rectangular in side view. The developing roller attaching portion 41 has a developing roller shaft insertion hole 43.

Each developing roller shaft insertion hole 43 is formed at the rear edge of the developing roller attaching portion 41. The developing roller shaft insertion hole 43 has a general circular shape in side view of which the rear end is opened. The developing roller shaft insertion hole 43 penetrates the developing roller attaching portion 41 in the left-right direction. The inner diameter of the developing roller shaft insertion hole 43 is larger than the diameter of the developing roller shaft 2A of the developing roller 2.

The protrusions 46 protrude in the inner direction of the seal facing portions 42 in the left-right direction, from the inner edges of the seal facing portions 42 in the left-right directions, and extend in the front-back direction. Each protrusion 46 has a generally rectangular shape in plan view. The inner edge portion of the protrusion 46 in the left-right direction is situated further inwards in the left-right direction than the inner face of the main portion 37 in the left-right direction. An upper face 46A of the protrusion 46 inclines downward toward the rear, and continues to the rear edge of the upper face 45A of the inclined portion 45 of the main portion 37, at the front edge portion of the outer edge portion in the left-right direction thereof. The upper face 46A of the protrusion 46 makes up a first inclined portion along with the upper face 45A of the inclined portion 45. A rear face 46B of the protrusion 46 extends vertically. The rear face 46B of the protrusion 46 continues to the rear edge of the upper face 46A at the upper edge thereof. The rear face 46B of the protrusion 46 continues to the rear face of the seal facing portion 42 at the outer edge in the left-right direction thereof. The rear face 46B of the protrusion 46 makes up a first facing surface along with the rear face 42A of the seal facing portion 42.

The lower wall 36 is disposed at the lower edge of the base frame 32, as illustrated in FIGS. 1 and 4A. The lower wall 36 integrally includes a first part 36A, a second part 36B, and a third part 36C.

The first part 36A is disposed at the front half of the base frame 32. The first part 36A has a general arc-shaped cross-section. The generally middle part of the first part 36A in the front-back direction is recessed downwards. The left and right ends of the first part 36A continue to the lower edges of the main portions 37 of the pair of side walls 34. The first part 36A makes up the bottom of the toner accommodating unit 5.

The second part 36B is disposed behind the first part 36A. The second part 36B has a general arc-shaped cross-section. The second part 36B continues to the rear edge of the first part 36A and extends backwards, curving so as to follow the perimeter face of the supply roller main unit 3B. The left and right ends of the second part 36B continue to the lower edges of the supply roller attaching portions 39 of the pair of side walls 34.

The third part 36C is disposed behind the second part 36B. The third part 36C has a generally straight line shape in cross-section. The third part 36C continues to the rear edge of the second part 36B and extends backwards. The left and right ends of the third part 36C continue to the lower edges of the developing roller attaching portions 41 of the pair of side walls 34.

The front wall 35 is disposed at the front edge of the base frame 32. The front wall 35 has a main unit 48 and a flange 47.

The main unit 48 extends upwards continuous to the front edge of the lower wall 36. The main unit 48 has a general plate shape, generally rectangular in frontal view, extending in the left-right direction. The left and right edge portions of the main unit 48 continue to the front edges of the main portions 37 of the pair of side walls 34. The main unit 48 makes up the front wall of the toner accommodating unit 5. An upper face 48A of the main unit 48 extends in the left-right direction, and continues to the upper face 37A of the main portion 37 of each of the pair of side walls 34, at the left and right ends thereof.

The flange 47 protrudes toward the front from the upper edge of the main unit 48 and extends in the left-right direction. The flange 47 has a general plate shape, generally rectangular in plan view. The left and right edge portions of the flange 47 continue to the front edges of the main portions 37 of the pair of side walls 34. The upper face 47A of the flange 47 extends in the left-right direction continuous from the upper face 48A of the main unit 48, and continues to the upper faces 37A of the main portions 37 of each of the pair of side walls 34, at the left and right ends thereof.

The upper faces 37A of the main portions 37 of the pair of side walls 34, the upper faces 44A of each of the flanges 44 of the pair of side walls 34, the upper faces 45A of the inclined portions 45 of the pair of side walls 34, the upper faces 46A of each of the protrusions 46 of the pair of side walls 34, the upper face 48A of the main unit 48 of the front wall 35, and the upper face 47A of the flange 47 of the front wall 35, make up a first welding surface.

(1-2) Cover Frame

Figure 6A:
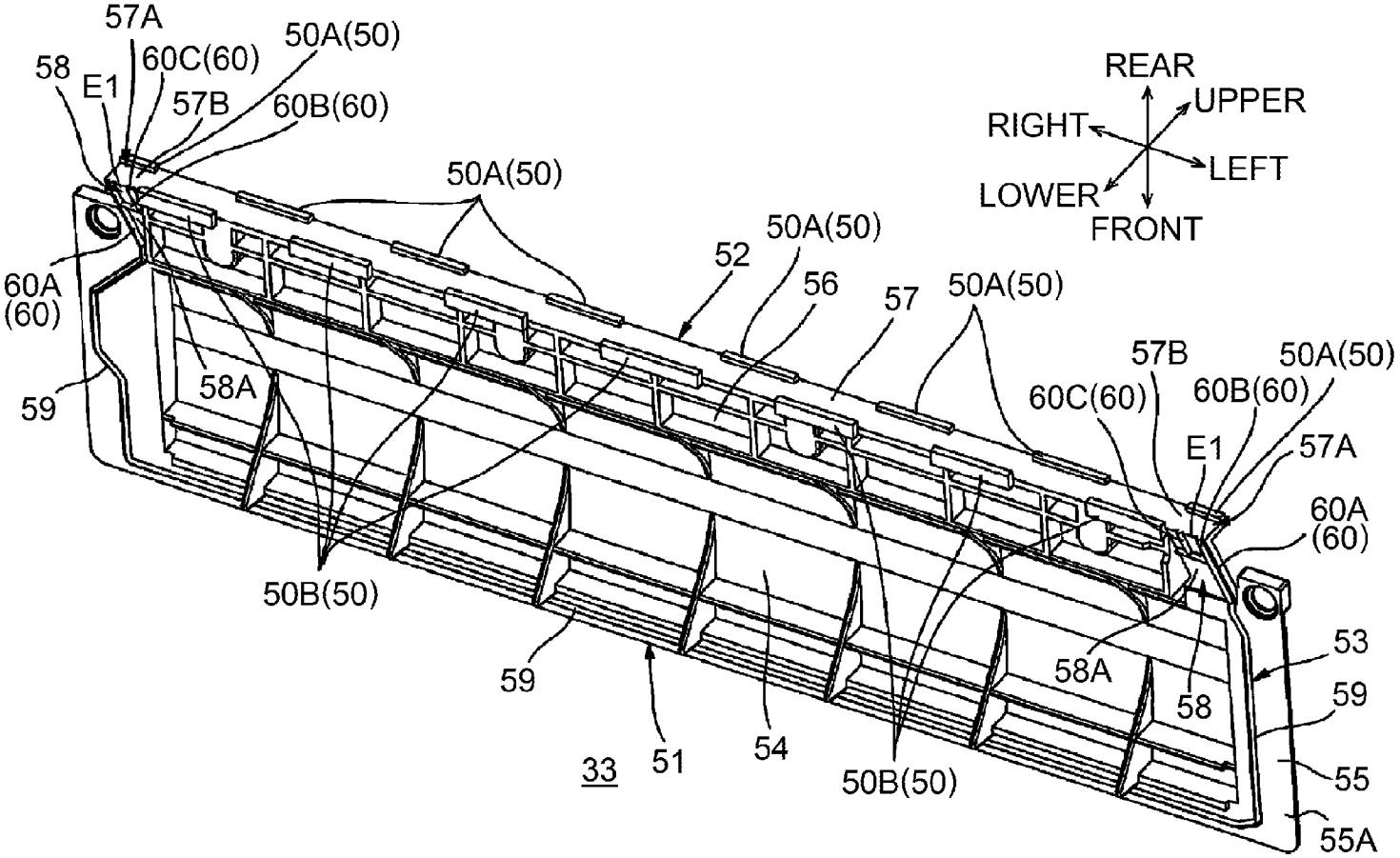
FIG. 6A is a perspective view illustrating a cover frame illustrated in FIG. 3 from the lower rear.

The cover frame 33 is disposed above the base frame 32, as illustrated in FIGS. 3 and 6A. The cover frame 33 integrally includes a covered portion 51, a seal supporting portion 52, and a welding rib 53.

The covered portion 51 makes up a great portion of the front of the cover frame 33. The covered portion 51 has a general plate shape, generally rectangular in plan view. The covered portion 51 makes up the upper wall of the toner accommodating unit 5. The covered portion 51 includes a main unit 54 and a flange 55.

The main unit 54 is disposed at the middle of the covered portion 51 in plan view. The main unit 54 has a frame shape, generally rectangular in plan view, with the upper end closed off and the lower end opened.

The flange 55 is disposed at the left and right edges and the front end of the covered portion 51, so as to surround the main unit 54. The flange 55 protrudes outwards in the left-right direction from the lower edges of the left and right edge portions of the main unit 54, and protrudes forward extending in the left-right direction from the lower edge of the front end of the main unit 54. The flange 55 has a general plate shape.

The seal supporting portion 52 is disposed to the rear of the covered portion 51. The seal supporting portion 52 includes an extending portion 56, a facing portion 57, and a pair of inclined portions 58.

The extending portion 56 extends rearwards continuing from the lower edge of the rear end of the main unit 54. The extending portion 56 has a general plate shape, generally rectangular in plan view.

The facing portion 57 is disposed at the rear end of the seal supporting portion 52. The facing portion 57 has a general plate shape, extending in the left-right direction. The front face of the facing portion 57 continues to the rear edge of the extending portion 56. The rear face of the facing portion 57 extends in the vertical direction. Each of the left and right end portions 57A of the facing portion 57 protrude farther outwards than the left and right end portions of the extending portion 56. Rear faces 57B of each of the left and right end portions 57A of the facing portion 57 are an example of a second facing surface. The facing portion 57 has multiple ribs 50.

The multiple ribs 50 are disposed on both vertical edges of the facing portion 57. Hereinafter, ribs 50 disposed on the upper edge of the facing portion 57 will be referred to as "upper ribs 50A", and ribs 50 disposed on the lower edge of the facing portion 57 will be referred to as "lower ribs 50B".

The multiple upper ribs 50A are arrayed in parallel in the vertical direction, along the left-right direction on the upper end of the facing portion 57 with intervals in between. The multiple upper ribs 50A protrude rearwards from the rear face of the facing portion 57, and extend in the left-right direction. The multiple upper ribs 50A each have rectangular shapes in rear view.

The multiple lower ribs 50B are arrayed in parallel in the vertical direction, along the left-right direction on the lower end of the facing portion 57 with intervals in between. The multiple lower ribs 50B protrude rearwards from the rear face of the facing portion 57, and extend in the left-right direction. The multiple lower ribs 50B each have rectangular shapes in rear view.

Each of the pair of inclined portions 58 is disposed to the left and right ends of the seal supporting portion 52. The pair of inclined portions 58 each has a general plate shape, generally rectangular in plan view, inclining downwards toward the rear. The front end of the pair of inclined portions 58 continues to the rear end portion of the main unit 54. The rear end of each of the pair of inclined portions 58 continue to the lower edges of the left and right end portions 57A of the facing portion 57. Moreover, the inner edge portions in the left-right direction of the pair of inclined portions 58 each continue to the ends of the extending portion 56 in the left-right direction. The left-right direction dimensions of the pair of inclined portions 58 are the same as the left-right direction dimensions of the protrusions 46 of the base frame 32. The rear ends of the lower faces 58A of the pair of inclined portions 58 continue from the lower edges of the rear faces 57B of each of the left and right end portions 57A of the facing portion 57. The lower faces 58A of the pair of inclined portions 58 are an example of a second inclined portion.

The lower face 55A of the flange 55 of the covered portion 51, and the lower faces 58A of the pair of inclined portions 58, make up a second welding surface.

Figure 6B:
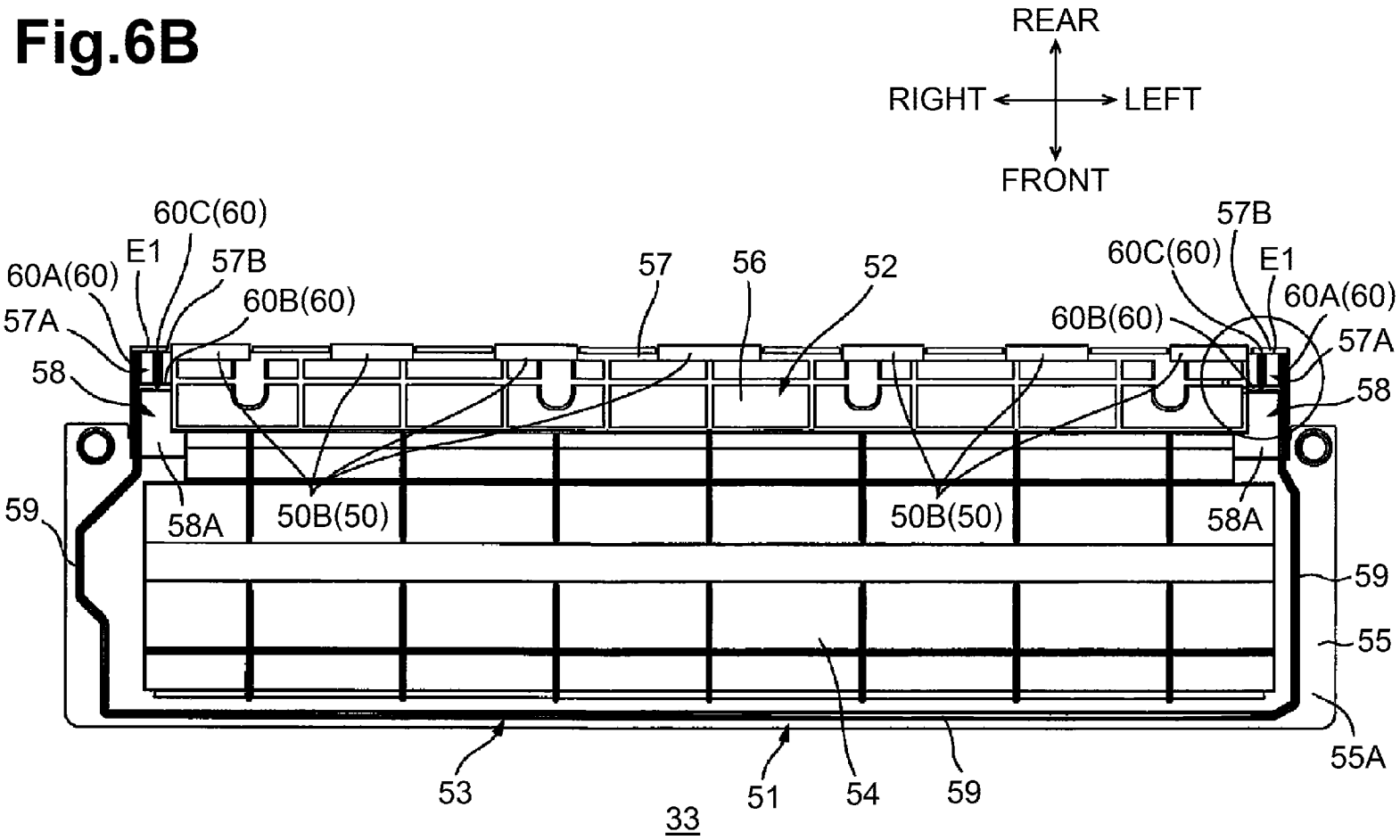
FIG. 6B is a bottom view of the cover frame illustrated in FIG. 3.
Figure 7:
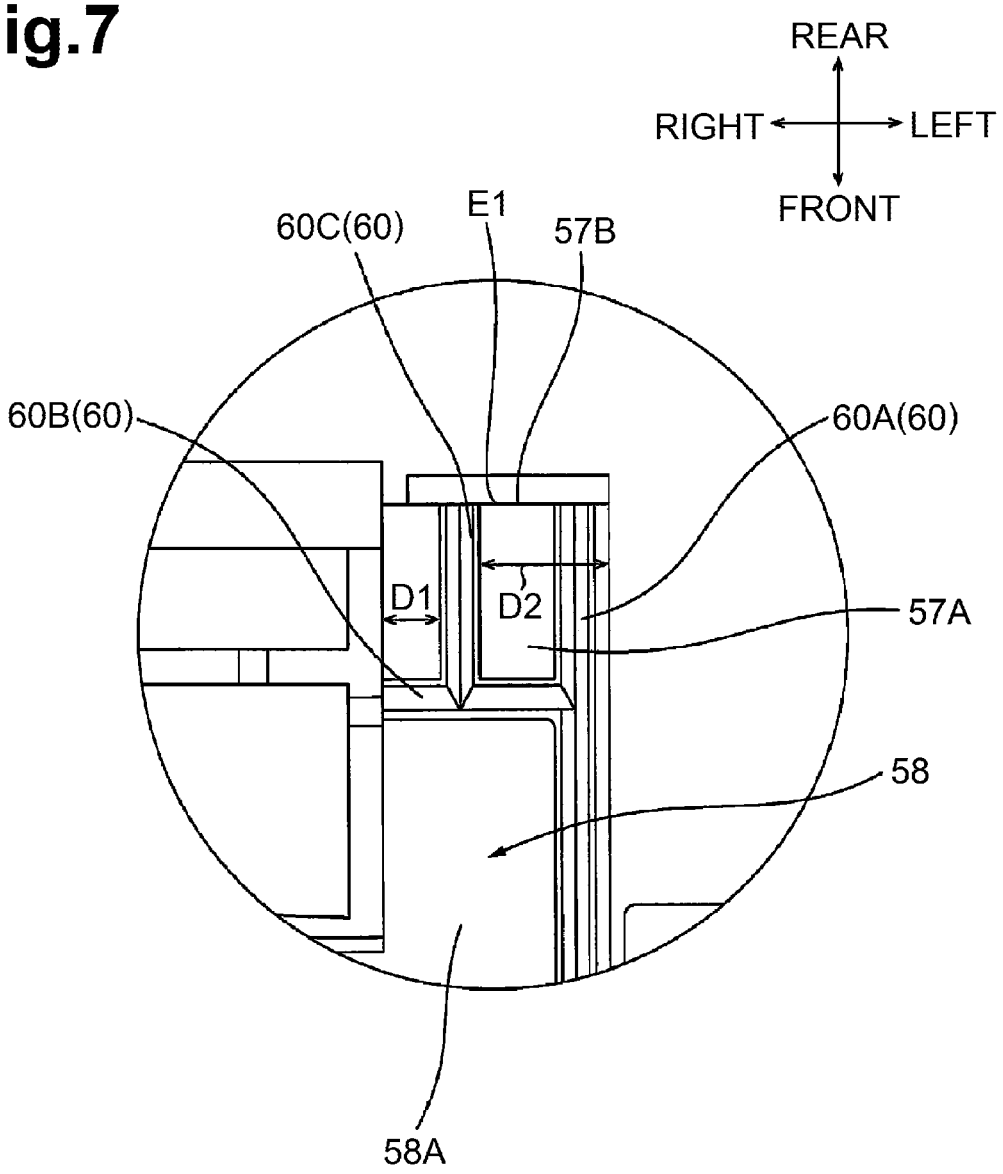
FIG. 7 is an enlarged diagram of principal portions of FIG. 6B.

The welding rib 53 has first welding ribs 59 and second welding ribs 60, as illustrated in FIGS. 6A through 7.

The first welding ribs 59 are situated on the lower face 55A of the flange 55. The first welding ribs 59 protrude down wards from the lower face 55A of the flange 55, and extend so as to surround the main unit 54. The rear ends of the left and right first welding ribs 59 are situated to the front of the outer ends of the pair of inclined portions 58 in the left-right direction.

The second welding ribs 60 are situated at the lower faces 58A of the pair of inclined portions 58. The second welding ribs 60 each have a first rib 60A, a second rib 60B, and a third rib 60C. This means that each of the pair of inclined portions 58 has a first rib 60A, a second rib 60B, and a third rib 60C.

The first rib 60A is disposed at the outer edge in the left-right direction of the inclined portion 58. The first rib 60A protrudes downwards from the lower face 58A of the inclined portions 58 and extends rearwards in a generally linear form.

The front end of the first rib 60A continues to the rear end of the first welding rib 59. The rear ends of the first ribs 60A are situated on the rear end edges E1 of the inclined portions 58 at the outer edge in the left-right direction.

The second rib 60B is situated at the general middle of the inclined portion 58 in the front-back direction. The second rib 60B protrudes downwards form the lower face 58A of the inclined portion 58, and extends in the left-right direction. The outer ends of the second ribs 60B in the left-right direction continue to the generally middle part of the first rib 60A in the front-back direction. The inner ends of the second ribs 60B continue to the outer ends of the extending portion 56 in the left-right direction.

The third ribs 60C are situated on the inward side in the left-right direction as compared to the general middle of the inclined portions 58 in the left-right direction. The third rib 60C protrudes downwards from the lower face 58A of the inclined portion 58 and extends in the front-back direction, parallel to the first rib 60A. The front ends of the third ribs 60C continue to the generally middle part of the second ribs 60B in the left-right direction. The rear ends of the third ribs 60C are situated on the inward side in the left-right direction as compared to the general middle of the rear end edges E1 of the inclined portions 58 in the left-right direction. A distance D1 between the inner end edges of the inclined portions 58 in the left-right direction and the third ribs 60C is shorter than a distance D2 between the outer end edges of the inclined portions 58 in the left-right direction and the third ribs 60C.

(1-3) Welding the Base Frame and Cover Frame

The developing frame 31 is assembled by positioning the cover frame 33 upon the base frame 32 from above and welding.

In a state where the cover frame 33 has been positioned upon the base frame 32, the flange 55 of the cover frame 33 comes into contact with the upper face 37A of the main portion 37 of the base frame 32, and the upper face 48A of the main unit 48 of the front wall 35, from above, as illustrated in FIG. 3. The seal supporting portion 52 of the cover frame 33 is situated between the blade attaching portions 40 of the base frame 32. The inclined portions 58 of the cover frame 33 come into contact with the upper faces 45A of the inclined portions 45 of the base frame 32, and the upper faces 46A of the protrusions 46, from above.

The cover frame 33 and base frame 32 are then welded by ultrasonic welding. The welding rib 53 of the cover frame 33 thus becomes molten, and the cover frame 33 is welded to the base frame 32 by the molten welding rib 53, at a welding region A indicated by dashed lines in FIGS. 4B and 5.

More specifically, the first welding rib 59 of the cover frame 33 becomes molten, and the flange 55 of the cover frame 33 is welded to the upper face 37A of the main portion 37 of the base frame 32 and the upper face 48A of the main unit 48 of the front wall 35 thereof.

Further, the second welding rib 60 of the cover frame 33 becomes molten, and the inclined portions 58 of the cover frame 33 are welded to the upper faces 45A of the inclined portions 45 of the base frame 32 and the upper faces 46A of the protrusions 46 thereof. A portion welded by the molten first rib 60A is a first portion A1 of a welding region A. A portion welded by the molten second rib 60B is a second part A2 of the welding region A. A portion welded by the molten third rib 60C is a third part A3 of the welding region A.

The first parts A1 are situated at the outer end portions in the left-right direction of the upper faces 45A of the inclined portions 45 of the base frame 32 and the upper faces 46A of the protrusions 46 thereof. The first parts A1 extend in the front-back direction. The rear ends of the first parts A1 are situated at rear end edges E2 at the outer end portions of the protrusions 46 in the left-right direction.

The second parts A2 are situated at the generally middle parts in the front-back directions of the upper faces 46A of the protrusions 46 of the base frame 32. The second parts A2 extend in the left-right direction. The outer ends of the second parts A2 in the left-right direction continue to the generally middle parts of the first parts A1 in the front-back direction. The inner ends of the second parts A2 in the left-right direction are situated at the inner end edges of the protrusions 46 of the base frame 32 in the left-right direction.

The third parts A3 are situated more on the inner side in the left-right direction than the generally middle in the left-right direction of the upper faces 46A of the protrusions 46 of the base frame 32. The third parts A3 extend in parallel with the first parts A1 in the front-back direction. The front ends of the third parts A3 continue to the generally middle part of the second parts A2 in the left-right direction. The rear ends of the third parts A3 are situated more on the inner side in the left-right direction than the generally middle part in the left-right direction of the rear end edges E2 of the protrusions 46. A distance D3 between the inner end edges in the left-right direction of the protrusions 46 of the base frame 32 and the third parts A3 is shorter than a distance D4 between the outer end edges in the left-right direction of the protrusions 46 of the base frame 32 and the third parts A3.

Once the cover frame 33 is welded to the base frame 32, assembly of the developing frame 31 is completed.

(2) Blade Seal

The blade seal 71 is disposed between the layer thickness regulating blade 4 and the seal supporting portion 52 of the cover frame 33, as illustrated in FIGS. 1 and 8. The blade seal 71 has a general square cylinder shape. The blade seal 71 extends in the left-right direction, and is formed of a resin sponge.

The middle part of the blade seal 71 in the left-right direction is in direct contact with the middle part of the rear face of the facing portion 57 of the cover frame 33 in the left-right direction, with no adhesive layer being introduced therebetween, as illustrated in FIGS. 3 and 8. The middle part of the blade seal 71 in the left-right direction is also supported between the multiple upper ribs 50A and multiple lower ribs 50B so as to be clasped and supported therebetween.

Further, each of the end parts of the blade seal 71 in the left-right direction is in direct contact with the rear faces 46B of the protrusions 46 of the base frame 32, the rear face 42A of the seal facing portion 42 of the base frame 32, and the rear faces 57B of the left and right end portions 57A of the facing portion 57 of the cover frame 33, with no adhesive layer being introduced therebetween. Accordingly, the left and right end portions of the blade seal 71 each seal off a seam 72 between the rear end edges E1 of the inclined portions 58 of the cover frame 33 and the rear end edges E2 of the protrusions 46 of the base frame 32. Also, the left and right end portions of the blade seal 71 are each in contact with the inner faces in the left-right direction of the developing roller attaching portions 41 of the pair of side walls 36.

Figure 5:
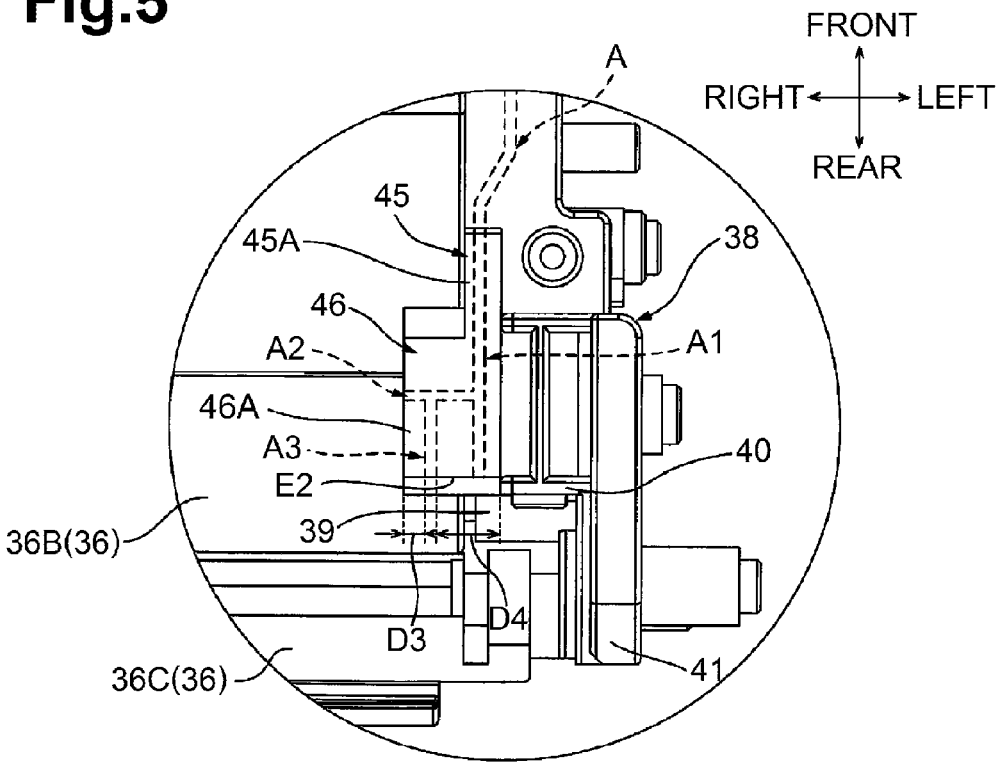
FIG. 5 is an enlarged diagram of principal portions of FIG. 4B.

4. Advantages (1) According to this developing cartridge 1, the first parts A1 of the welding region A extend in the front-back direction, as illustrated in FIGS. 4B and 5. The rear end edges of the first parts A1 extend to the rear end edges E2 of the protrusions 46 of the base frame 32 and the rear end edges E1 of the inclined portions 58 of the cover frame 33.

That is to say, the first parts A1 weld the protrusions 46 of the base frame 32 and the inclined portions 58 of the cover frame 33 in the front-back direction.

The second parts A2 extend from the first parts A1 to the inner side in the left-right direction. The inner end edge in the left-right direction of the second parts A2 extend to the inner end edge in the left-right direction of the protrusions 46 of the base frame 32 or inclined portions 58 of the cover frame 33.

That is to say, the second parts A2 weld the protrusions 46 of the base frame 32 and the inclined portions 58 of the cover frame 33 in the left-right direction, on the inner side from the first parts A1 in the left-right direction.

Accordingly, toner leakage to the outer side in the left-right direction can be restricted by the first part A1, while toner leakage to the rear can be restricted by the second part A2.

Consequently, the seam 72 between the protrusions 46 of the base frame 32 and the inclined portions 58 of the cover frame 33 can be sealed in a sure manner.

(2) According to this developing cartridge 1, the welding region A has third parts A3 situated on the with spacing in the left-right direction from the first parts A1, as illustrated in FIGS. 4B and 5. The third parts A3 extend in parallel to the first parts A1. The rear end edges of the third part A3 are situated at the rear end edges E1 of the inclined portions 58 of the cover frame 33 or the rear end edges E2 of the protrusions 46 of the base frame 32.

That is to say, the third part A3 weld the protrusions 46 of the base frame 32 and the inclined portions 58 of the cover frame 33 in the front-back direction, on the inner side in the left-right direction from the first parts A1.

Accordingly, external toner leakage in the left-right direction can be restricted by the third parts A3, on the inner side in the left-right direction from the first parts A1.

Consequently, the seam 72 between the protrusions 46 of the base frame 32 and the inclined portions 58 of the cover frame 33 can be sealed in a sure manner.

(3) According to this developing cartridge 1, the distance D1 between the inner end edges of the inclined portions 58 of the cover frame 33 in the left-right direction and the third ribs 60C is shorter than the distance D2 between the outer end edges of the inclined portions 58 of the cover frame 33 in the left-right direction and the third ribs 60C, as illustrated in FIGS. 6B and 7.

Moreover, the distance D3 between the outer end edges in the left-right direction of the protrusions 46 of the base frame 32 and the third parts A3 is shorter than the distance D4 between the inner end edges in the left-right direction of the protrusions 46 of the base frame 32 and the third parts A3, as illustrated in FIGS. 4B and 5.

Accordingly, the seam 72 between the protrusions 46 of the base frame 32 and the inclined portions 58 of the cover frame 33 can be sealed further inwards in the left-right direction.

Consequently, the seam 72 between the protrusions 46 of the base frame 32 and the inclined portions 58 of the cover frame 33 can be sealed in an even more sure manner.

(4) According to this developing cartridge 1, each of the pair of inclined portions 58 has a first rib 60A, a second rib 60B, and a third rib 60C, as illustrated in FIGS. 6B and 7.

Also, the first parts A1, second part A2, and third parts A3 of the welding region A are situated on the upper faces 45A of the left and right inclined portions 45 and upper faces 46A of the left and right protrusions 46 of the base frame 32, as illustrated in FIGS. 4B and 5.

Now, if the inclined portions 45 and protrusions 46 of the base frame 32, and the inclined portions 58 of the cover frame 33 are inclined, slanted intersection may occur between the inclined portions 45 and protrusions 46 of the base frame 32 and the inclined portions 58 of the cover frame 33. This slanted intersection may make a tight fit between the inclined portions 45 and protrusions 46 of the base frame 32 and the inclined portions 58 of the cover frame 33 difficult when fitting the base frame 32 and the cover frame 33 together.

On the other hand, the welding region A of the above-described configuration, for welding the inclined portions 45 and protrusions 46 of the base frame 32 and the inclined portions 58 of the cover frame 33, has the first part A1, second part A2, and third part A3.

Accordingly, even if there is slanted intersection among the inclined portions 45 and protrusions 46 of the base frame 32 and the inclined portions 58 of the cover frame 33, the seam 72 between the inclined portions 45 and protrusions 46 of the base frame 32 and the inclined portions 58 of the cover frame 33 can be sealed in an even more sure manner.

(5) According to this developing cartridge 1, both end portions of the blade seal 71 in the left-right direction are disposed between the rear face 46B of the protrusion 46 of the base frame 32 and rear face 42A of the seal facing portion 42 of the base frame 32, and respective rear faces 57B of the end portions of the facing portion 57 of the cover frame 33 in the left-right direction, and the layer thickness regulating blade 4, as illustrated in FIGS. 1, 3 and 8.

Accordingly, the ends of the blade seal 71 in the left-right direction can seal the seam 72 between the rear end edges E1 of the inclined portions 58 of the cover frame 33 and the rear end edges E2 of the protrusions 46 of the base frame 32 in a more sure manner.

Moreover, the first ribs 60A of the welding rib 53 extend to the rear end edges E2 of the protrusions 46 of the base frame 32 and the rear end edges E1 of the inclined portions 58 of the cover frame 33.

Accordingly, welding the protrusions 46 of the base frame 32 and the inclined portions 58 of the cover frame 33 causes the molten first rib 60A to expand further rearwards than the rear end edges E2 of the protrusions 46 of the base frame 32 and the rear end edges E1 of the inclined portions 58 of the cover frame 33.

Now, the blade seal 71 is in direct contact with the rear face 42A of the seal facing portion 42 of the base frame 32, and the rear faces 57B of the left and right end portions of the facing portion 57 of the cover frame 33, with no adhesive layer being introduced therebetween.

Accordingly, the blade seal 71 deforms corresponding to the expanding molten first rib 60A, and is tightly adhered to the expanding first rib 60A.

Consequently, the seam 72 between the rear end edges E1 of the inclined portions 58 of the cover frame 33 and the rear end edges E2 of the protrusions 46 of the base frame 32 can be sealed in an even more sure manner.

5. Modifications

Modifications of the developing cartridge 1 will be described with reference to FIGS. 9A through 10B. Portions in the following modifications where are the same as those in the above-described embodiment are denoted with the same reference numerals, and description thereof will be omitted.

(1) First Modification

The welding region A of the base frame 32 and cover frame 33 in the above-described embodiment has the third parts A3 situated on the inner side of the first parts A1 in the horizontal direction.

Figure 9A:
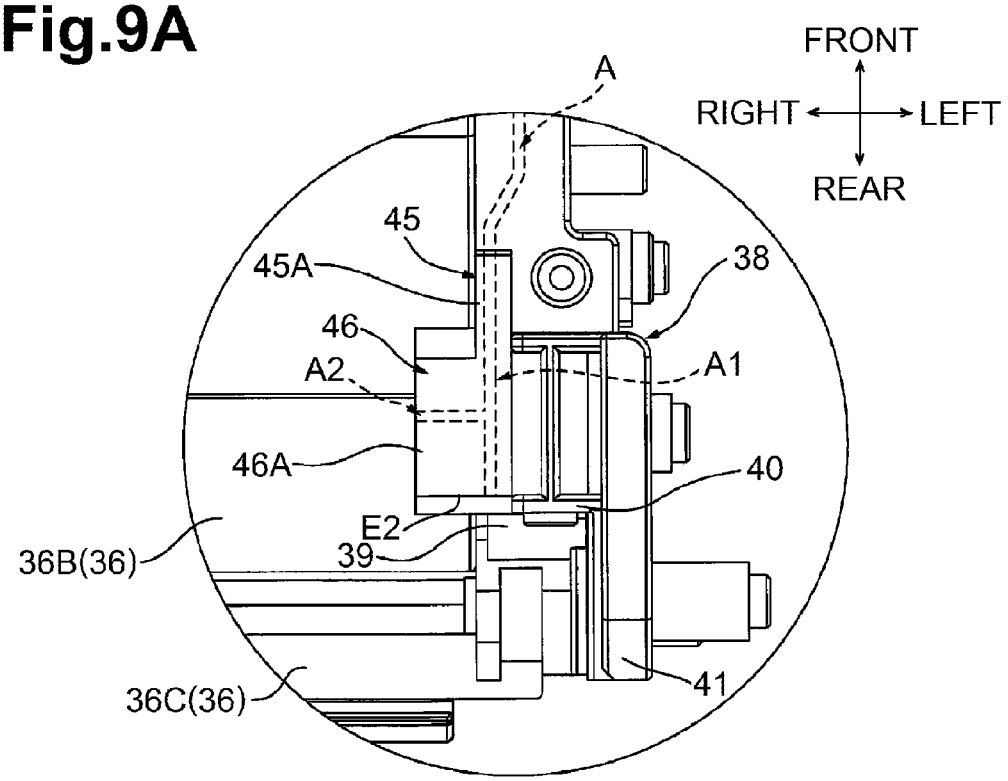
FIG. 9A is an explanatory diagram describing a first modification of the developing cartridge of the present invention.

On the other hand, the welding region A according to the first modification does not have the third parts A3, as illustrated in FIG. 9A.

This first modification yields the same advantages as the above-described embodiment.

(2) Second Modification

The welding region A of the base frame 32 and cover frame 33 in the above-described embodiment extends continuously in a generally straight line in the front-back direction.

Figure 9B:
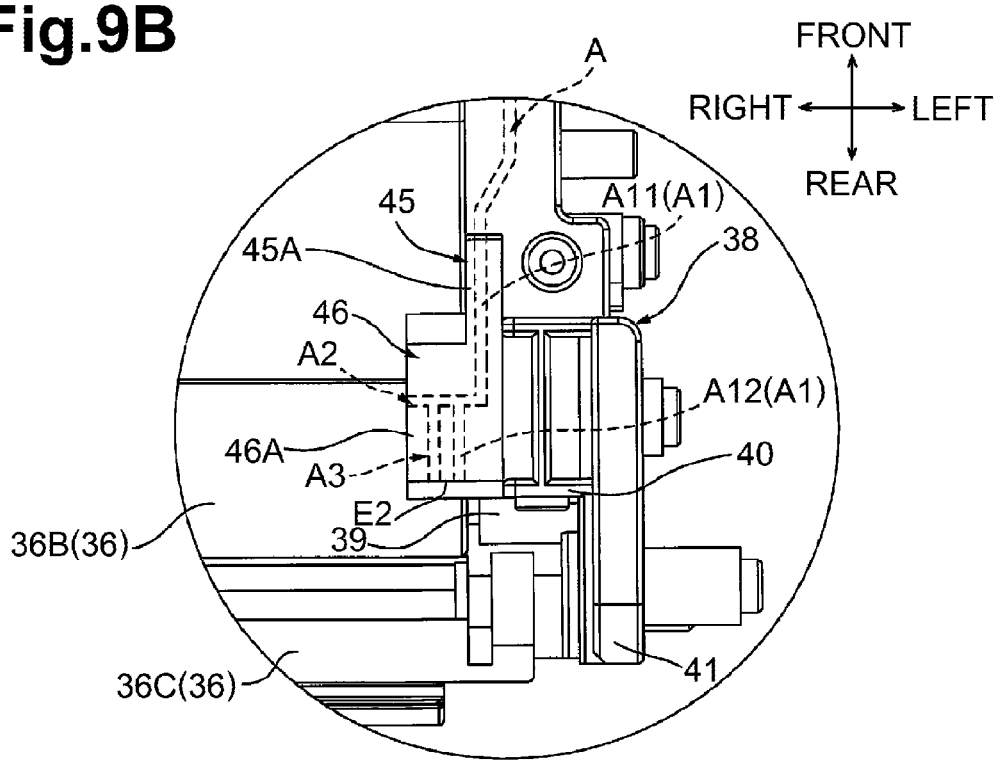
FIG. 9B is an explanatory diagram describing a second modification of the developing cartridge of the present invention.

On the other hand, in the second modification the first part A1 of the welding region A is divided into a part A11 to the front of the second part A2 and a part A12 to the rear of the second part A2, partway in the front-back direction, as illustrated in FIG. 9B.

More specifically, the front half part A11 of the first part A1 extends in the front-back direction. The rear end of the front half part A11 of the first part A1 continues to the outer end of the second part A2 in the left-right direction.

Conversely, the back half part A12 of the first part A1 extends continuously backwards slightly outwards in the left-right direction from the middle of the second part A2 in the left-right direction. The rear end of the back half part A12 of the first part A1 is situated at the rear end edge E2 of the protrusion 46.

This second modification yields the same advantages as the above-described embodiment.

(3) Third Modification

The above-described first and second modifications may be combined.

Figure 10A:
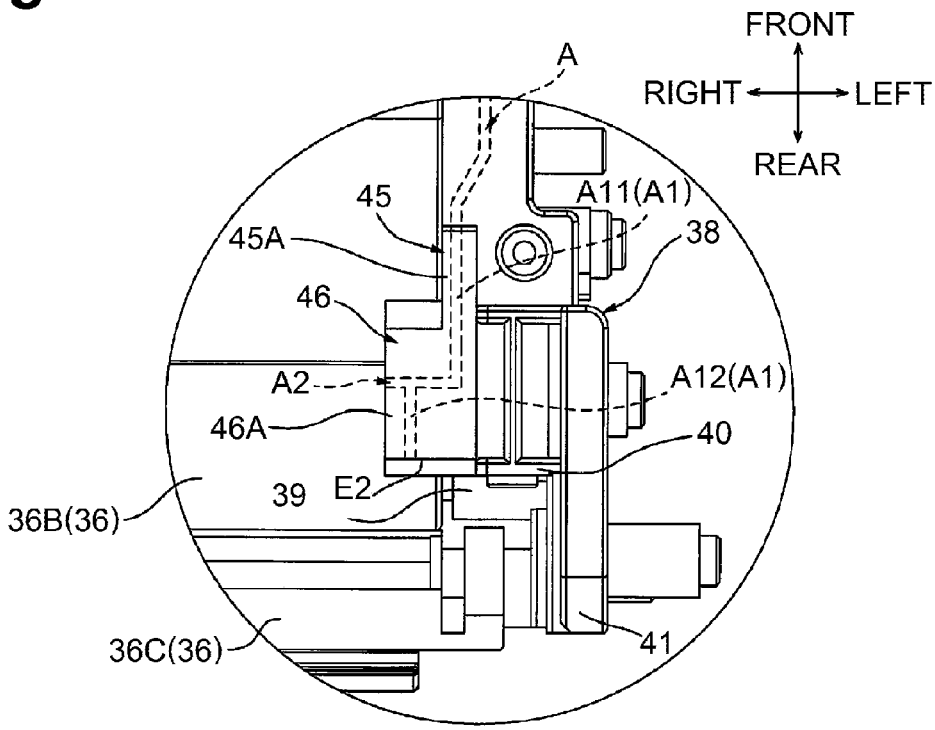
FIG. 10A is an explanatory diagram describing a third modification of the developing cartridge of the present invention.

The welding region A according to the third modification does not have the third part A3 as in the first modification, and the first part A1 is divided into the part A11 to the front of the second part A2 and the part A12 to the rear of the second part A2, partway in the front-back direction, as with the second modification, as illustrated in FIG. 10A.

This third modification yields the same advantages as the above-described embodiment.

(4) Fourth Modification

The second part A2 of the welding region A in the above-described third modification extends continuously in a generally straight line in the left-right direction.

Figure 10B:
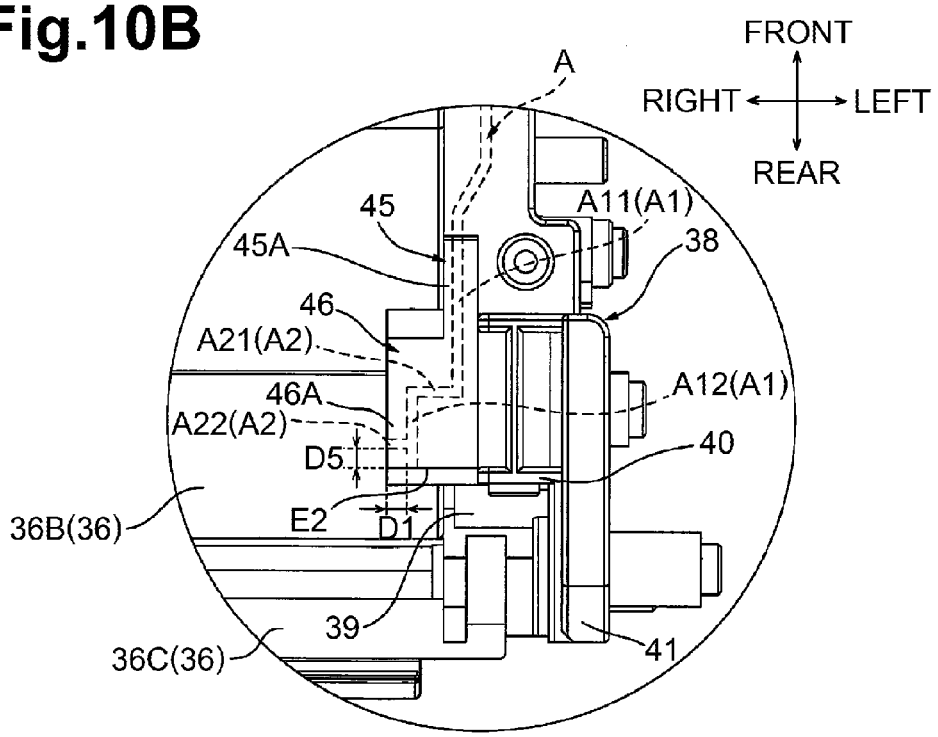
FIG. 10B is an explanatory diagram describing a fourth modification of the developing cartridge of the present invention.

On the other hand, in a fourth modification, the second part A2 of the welding region A is divided into a part A21 to the outer side in the left-right direction as compared to the back half part A12 of the first part A1, and a part A22 to the inner side in the left-right direction as compared to the back half part A12 of the first part A1, partway in the left-right direction, as illustrated in FIG. 10B.

More specifically, the left-right outer part A21 of the second part A2 extends inwards in the left-right direction from the rear end of the front half part A11 of the first part A1. The left-right outer part A21 of the second part A2 continues to the front end of the back half part A12 of the first part A1.

Also, the left-right inner part A22 of the second part A2 extends continuously inwards in the left-right direction from partway along the back half part A12 of the first part A1. The left-right inner part A22 of the second part A2 is situated at the inner edge of the protrusion 46 in the left-right direction.

A distance D5 between the rear end edge E2 of the inclined portions 58 and the left-right inner part A22 of the second part A2 is the same as the distance D1 between the inner edge of the inclined portion 58 in the left-right direction and the rear edge of the back half part A12 of the first part A1.

According to the fourth modification, the distance D5 between the rear end edge E2 of the inclined portions 58 and the second part A2, inward from the first part A1 in the loft-right direction, can be reduced further.

Thus, the size of the region on the inner side of the first part A1 in the left-right direction and behind the second part A2 can be reduced.

Accordingly, toner can be suppressed from entering the region on the inner side of the first part A1 in the left-right direction and behind the second part A2, and thus leakage of toner from the seam 72 between the inclined portions 45 and protrusions 46 of the base frame 32 and the inclined portions 58 of the cover frame 33, through the on the inner side of the first part A1 in the left-right direction and behind the second part A2, can be suppressed.

Consequently, the seam 72 between the inclined portions 45 and protrusions 46 of the base frame 32 and the inclined portions 58 of the cover frame 33 can be sealed in an even more sure manner.

What is claimed is:

1. A developing cartridge comprising:

a housing configured to accommodate a developing agent and comprising:

a first frame; and a second frame;

a developing agent carrying member rotatable on an axial line and configured to carry the developing agent; and a layer thickness regulating member configured to regulate a layer thickness of the developing agent carried by the developing agent carrying member;

wherein the first frame has a first facing surface facing the layer thickness regulating member, wherein the second frame has a second facing surface facing the layer thickness regulating member, and wherein a welded region where the first frame and the second frame are welded comprises:

a first welded portion extending from the first facing surface in a first direction intersecting with and away from the first facing surface; and a second welded portion extending from the first welded portion inward in a second direction intersecting with the first direction;

wherein the first frame has a first inclined portion inclining with respect to the first direction at an end portion of the first frame in the first direction, wherein the second frame has a second inclined portion inclining along the first inclined portion at an end portion of the second frame in the first direction, wherein the welded region extends through the first inclined portion and the second inclined portion together defining the first welded portion and the second welded portion, and wherein the welded region comprises a third welded portion which is positioned inward the first welded portion in the second direction with a space and extends from the second welded portion in parallel with the first welded portion with spacing in the second direction therebetween, and the first welded portion and the third welded portion at least partially overlap in a direction parallel to the axial line of the developing agent carrying member.

2. The developing cartridge according to claim 1, wherein a distance between an inner end edge of the first frame in the second direction and the third welded portion is shorter than a distance between an outer end edge of the first frame in the second direction and the third welded portion.

3. The developing cartridge according to claim 1, wherein a distance between an end edge of the first frame in the first direction and the second welded portion is equal to or shorter than a distance between an inner end edge of the first frame in the second direction and the first welded portion.

4. The developing cartridge according to claim 1, further comprising a seal disposed between the first facing surface and the second facing surface, and the layer thickness regulating member.

5. The developing cartridge according to claim 4, wherein the seal contacts the first facing surface and the second facing surface.

* * * * *